US011911677B2

(12) United States Patent
Wessel

(10) Patent No.: US 11,911,677 B2
(45) Date of Patent: Feb. 27, 2024

(54) PADDED TRAINING BOARD

(71) Applicant: Conley Wessel, Oceanside, CA (US)

(72) Inventor: Conley Wessel, Oceanside, CA (US)

( * ) Notice: Subject to any disclaimer, the term of this patent is extended or adjusted under 35 U.S.C. 154(b) by 135 days.

(21) Appl. No.: 17/650,597

(22) Filed: Feb. 10, 2022

(65) Prior Publication Data

US 2022/0266111 A1 Aug. 25, 2022

Related U.S. Application Data

(60) Provisional application No. 63/200,233, filed on Feb. 23, 2021.

(51) Int. Cl.

| | |
|---|---|
| ***A63B 69/00*** | (2006.01) |
| *A63B 102/18* | (2015.01) |
| *A63B 71/02* | (2006.01) |

(52) U.S. Cl.

CPC ..... *A63B 69/00* (2013.01); *A63B 71/03* (2020.08); *A63B 2102/18* (2015.10); *A63B 2214/00* (2020.08); *A63B 2243/007* (2013.01); *A63B 2243/0025* (2013.01)

(58) Field of Classification Search

CPC ..... A63B 71/03
USPC ..... 473/452
See application file for complete search history.

(56) References Cited

U.S. PATENT DOCUMENTS

| | | | | |
|---|---|---|---|---|
| 4,779,796 | A * | 10/1988 | Lai | A63B 69/3652 473/279 |
| 4,810,560 | A * | 3/1989 | Sell | A63B 69/0013 473/490 |
| 5,046,741 | A | 9/1991 | Ahn | |
| 5,467,977 | A * | 11/1995 | Beck | A63B 69/0013 473/497 |
| 5,967,911 | A * | 10/1999 | McAvoy | A63B 69/0071 473/447 |
| 6,623,373 | B2 * | 9/2003 | Carlton | A63B 69/3661 473/278 |
| 7,901,304 | B1 | 3/2011 | Moore | |
| 7,909,747 | B1 * | 3/2011 | LaCaze | A63B 21/00069 482/142 |
| 8,216,095 | B2 * | 7/2012 | Weber | E01C 13/08 473/497 |
| D705,374 | S * | 5/2014 | Puccetti | D21/780 |
| 9,586,121 | B1 | 3/2017 | Carlson et al. | |
| D855,723 | S * | 8/2019 | Sjostrom | D21/791 |
| 2006/0142099 | A1 * | 6/2006 | Trucks | A63B 69/0002 473/452 |
| 2007/0191128 | A1 | 8/2007 | Tirol | |
| 2010/0267498 | A1 * | 10/2010 | Bard | A63B 69/0002 473/452 |

(Continued)

FOREIGN PATENT DOCUMENTS

| | | | |
|---|---|---|---|
| JP | 2009112549 | A | 5/2009 |
| JP | 2020110281 | A | 7/2020 |
| KR | 20150004111 | A | 1/2015 |

OTHER PUBLICATIONS

Turf Triangle Box, Dalman Jump co, Feb. 3, 2021.

*Primary Examiner* — Mitra Aryanpour
(74) *Attorney, Agent, or Firm* — Scott C Harris, Esq

(57) ABSTRACT

A slant board device, formed of a base on the ground, and supporting a slanted top surface. The top surface has a pad and artificial grass. The top surface is used as a slant board for exercizing with cleats on.

3 Claims, 3 Drawing Sheets

(56) References Cited

U.S. PATENT DOCUMENTS

| | | | | |
|---|---|---|---|---|
| 2013/0345000 | A1* | 12/2013 | Gangwer | A63B 69/0002 473/497 |
| 2022/0266111 | A1* | 8/2022 | Wessel | A63B 69/00 473/452 |

* cited by examiner

PADDED TRAINING BOARD

This application claims priority from Provisional Application No. 63/200,233, filed Feb. 23, 2021, the entire contents of which are herewith incorporated by reference.

BACKGROUND

A foot board can be used to allow athletes to practice placing their feet in proper positions for different kinds of activities. Foot placement guidance of this type can also be used in physical therapy settings. Proper foot placement can reduce risk of injury during sports events.

A slant board is a flat-surfaced device that is used for training by standing in a slanted position on the board. This can improve the performance of the muscles for exercise and cut down on cases of injury The inventor recognized that existing slant boards do not adequately address training issues, as described herein.

SUMMARY OF THE INVENTION

The inventor recognized that there are a number of drawbacks with the current systems such as slantboards.

One such drawback is that on existing devices of this type, athletes cannot safely perform exercises while wearing cleats. This means that athletes often cannot wear the actual shoes they will use during the gameplay.

The present application describes a slant board that uses artificial grass along with padding to allow users to practice foot positions while wearing cleats and other traction-improving structures. The slant board has structure to promote proper foot placement strategy and loading patterns in the field of play for athletes.

BRIEF DESCRIPTION OF THE DRAWINGS

In the Drawings.

the figures show aspects of the invention, and specifically.

DETAILED DESCRIPTION

Figure 1:
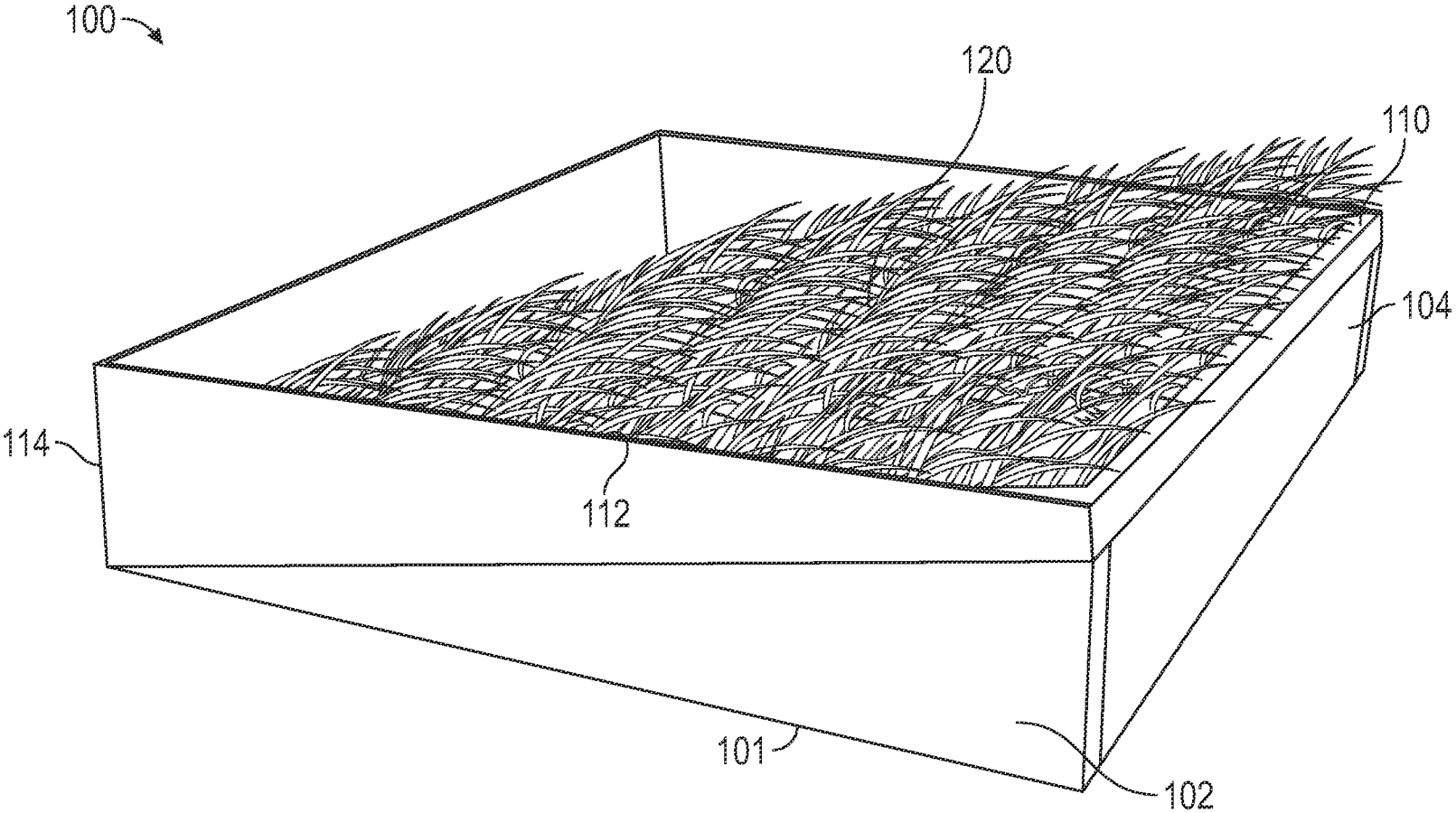
FIG. 1 shows a side on view of the device according to a first embodiment.

The present application describes a angle shaped platform with artificial grass on a flat but inclined surface, with padding underneath the artificial grass.

The platform in one embodiment is formed of wood, but can be formed of other materials such as plastic or metal. The platform 100 has a bottom surface 101 which sits on the ground. The top surface 112 is intended to be interacted with by the user of the platform. The top surface 112 is covered with a padding 114, such as car padding, rubber matting or carpet padding. Artificial grass 120 is layered on top of the padding 114.

The padding 114 is preferably thick enough to allow a user to wear cleats when stepping on the top surface. That is, the padding 114 and artificial grass is thick and spongy enough to absorb the force of an entire cleat on the bottom of a user's shoe. The cleat will not penetrate any of the materials, due to its spongy nature. Also, the materials are thick enough that the cleat will not entend through the materials (artificial grass and padding) and touch the material of the top surface 112 that is underneath the padding.

In an embodiment, the system can be used with conventional cleats, which are typically are sized between 3/16 inch and 1/4 inch.

In an embodiment, 3/8 inch carpet padding is used, with conventional artificial grass, e.g., Astroturf which can have a thickness between 1 and 1½ inches. This produces a thickness that is adequate to absorb the force and pressure from conventional sized cleats.

In an embodiment, this forms a system where cleats can be used on this practice board, and the location of the cleats pushes down the artificial grass and the padding on the artificial turf and on the padding itself, allowing the cleats to change the shape of the artificial padding temporarily while the cleats are pressing against the top surface, and where the pad then retains its original shape after the foot and cleats is removed.

In embodiments, the device varies from 9×12 to 2'×2', although other sizes are also possible. The angle of the platform can range from 2° (very slight incline) up to 45° for a steeper incline and also all sizes in between.

In an embodiment, shown in FIG. 1, the device is made of wood. Two wood triangle sides 102 form side surfaces of the device, and the bottom surface of the wood triangle sides 102 form two parts of the bottom surface 101 of the device. A wood rectangle 104 forms the rear surface of the device, and a bottom surface of that rear surface again forms the bottom surface 101. The top surfaces of the two triangle sides 102 and the rectangle 104 forms a triangle base, on top of which is formed a rectangular wood plank 110. The top surface 112 of the wood plank 110 receives the user's foot during exercize. The top surface 112 has a layer 114 of padding, covered with another layer 120 of artificial grass.

This embodiment defines a closed side device, where the sides 102 close in the edges of the device.

In this embodiment, the wooden rectangle 104 can vary with the platform size, from 12 to 24 inches for example. The wood plank can range from 12×9 to 24×24, in preferred embodiments. Rubber padding or carpet padding and artificial grass such as "Astroturf" can be sized to match the plank size.

Figure 2:
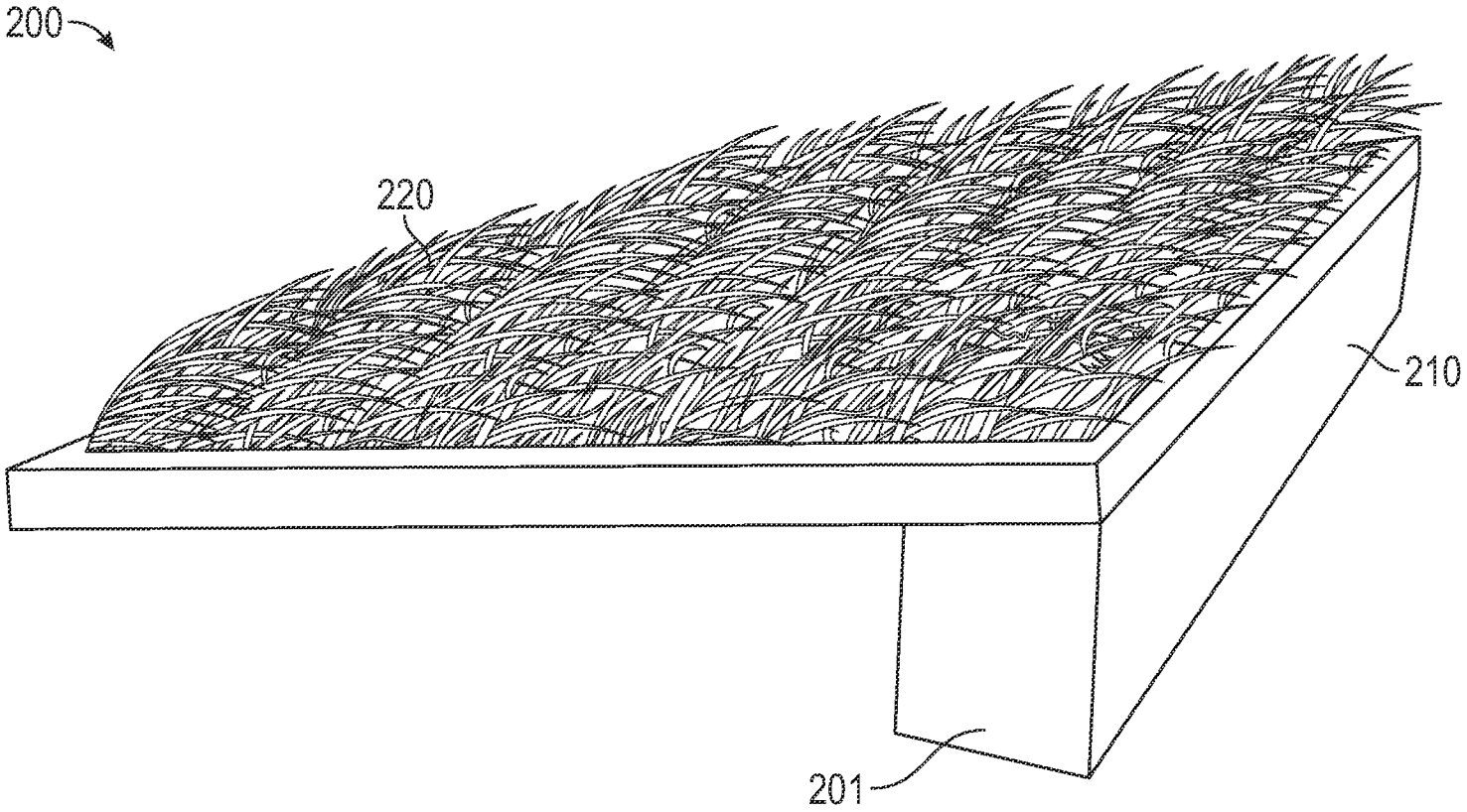
FIG. 2 shows an alternative embodiment.

A second embodiment, shown in FIG. 2, has an open side device, where there are open sides 200, only using a support part 210 in the front so that the bottom surface 201 of the device extends between an edge surface of the wooden plank, and the bottom surface of the support part 210. The support part 210 is shaved at an angle to create the pitch, which can be a pitch between 2° and 45° in different embodiments. The top surface 220 of the board can be formed with a wooden plank, which as in other embodiments, can be covered with padding and artificial grass.

Figure 3:
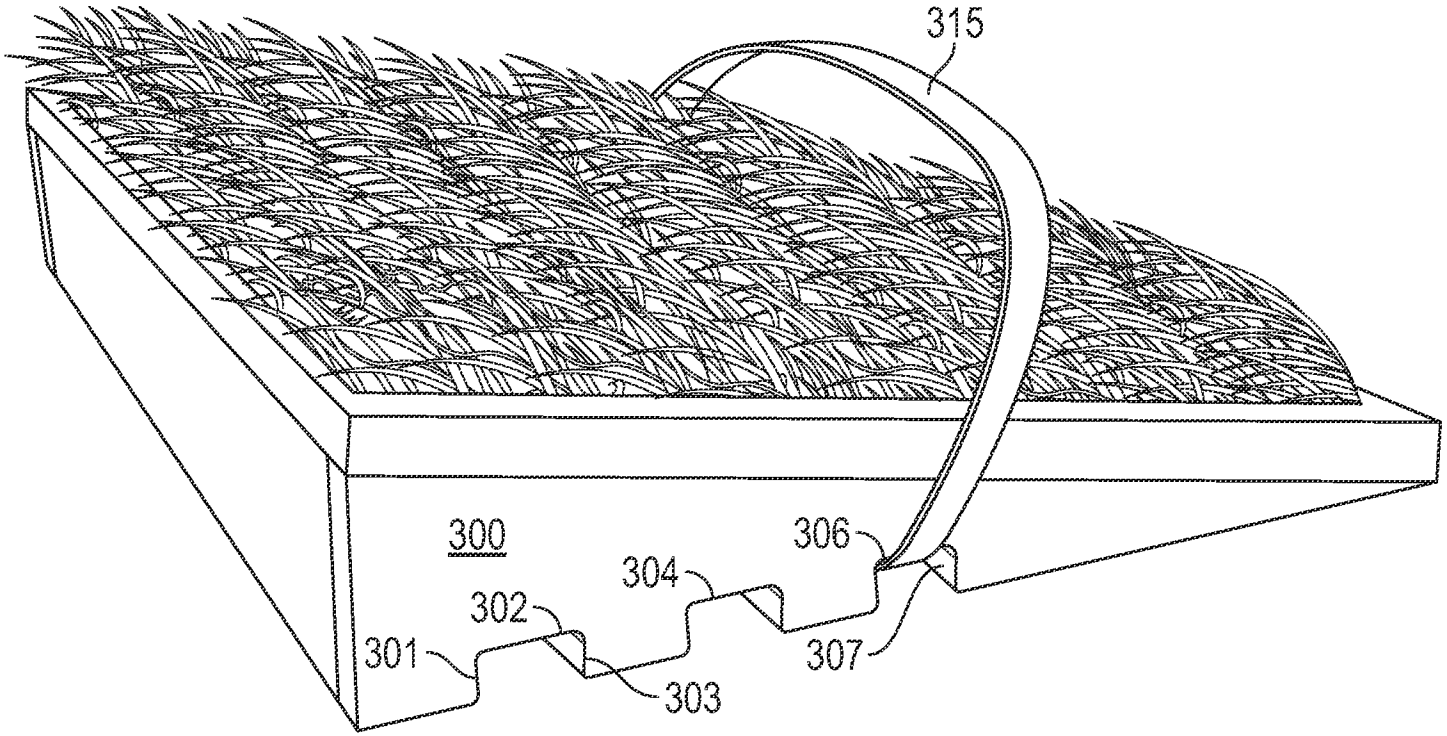
FIG. 3 shows a third embodiment, with additional surfaces.

A third embodiment, shown in FIG. 3, has side pieces 300 which include grooves or notches, 302, 304, 306 in the bottom surface. The grooves provide openings, forming surface edges such as 301, 303 which hold better to the surface below, especially when on a natural surface such as grass. The grooves open in a bottom surface of the base, facing toward the ground. A top surface of the grooves forms a border within the structural surface of the base, that is the grooves do not extend completely through the structural surface area of the base.

In addition, the grooves such as 306 have inside surfaces such as 307 that enable a user to loop a resistance band such as 315 through the notches, to allow different kinds of resistance band exercises. The wristband can be an elastic device.

In an embodiment, since artificial grass is used along with padding, the user can wear cleats while using the device. The cleats may deform or dig into the artificial grass, and may also deform or dig in to the space of the padding under the artificial grass, However, the cleats digging in to the artificial grass and padding simulates the way that cleats dig into grass and dirt on a field of play.

The purpose of this device is to promote proper foot planting or foot placement strategy and loading patterns for athletes. The athletes can drill while wearing the cleats that they will normally wear during the play, to carry out sport specific drills for different sports including soccer, football, and baseball. By using a slant board, this promotes straight foot planting, which study shows can reduce the risk of ACL injuries.

Use of such a slant board strengthens the lateral edge of the foot, as well as strengthening the ankle and hip, and thus can reduce ankle sprains and ligamentous injuries. Users can carry out specific exercises and movements that mimic actual gameplay while wearing the actual cleats that they would use during the gameplay.

The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. For example, the system can be used in a weight room, physical therapy, and joint positioning settings. Thus, the present invention is not intended to be limited to the embodiments shown herein but is to be accorded the widest scope consistent with the principles and novel features disclosed herein.

What is claimed is:

1. A slant board device, comprising:

a base, having a first surface sized and adapted to touch ground, and the first surface facing in a first direction toward a bottom of the device, the base having a second surface, facing in a second opposite direction from the first direction, and the second supported by the first surface, the second surface being a flat surface extending at a tilt forming a nonzero angle relative to the ground, a pad, covering the second surface, and an artificial grass surface, covering the pad, and covering the second surface over the pad, forming a slanted surface covered with padding, wherein the base having grooves in a bottom surface thereof, the grooves opening to the ground, and having a top surface bordered within the base, and further comprising an elastic device, extending through the grooves in the base and pressing against one of the surfaces of the grooves.

2. The slant board device as in claim 1, wherein the pad and said artificial grass surface have a thickness effective to absorb a force from being stepped on with a shoe cleat.

3. The slant board device as in claim 1, wherein the pad and artificial grass surface extend at an angle relative to the ground, between 2° and 45°.

* * * * *